US007988425B1

(12) United States Patent
Stingl

(10) Patent No.: US 7,988,425 B1
(45) Date of Patent: Aug. 2, 2011

(54) PUMP AND ALARM CONTROL

(76) Inventor: David A. Stingl, Great Falls, VA (US)

( * ) Notice: Subject to any disclaimer, the term of this patent is extended or adjusted under 35 U.S.C. 154(b) by 1256 days.

(21) Appl. No.: 11/447,301

(22) Filed: Jun. 6, 2006

(51) Int. Cl.
*F04B 49/06* (2006.01)

(52) U.S. Cl. ..... 417/44.2; 417/63; 4/509

(58) Field of Classification Search ..... 340/626, 340/606; 417/63, 42, 53, 44.2; 4/508, 509, 4/504

See application file for complete search history.

(56) References Cited

U.S. PATENT DOCUMENTS

| | | | | |
|---|---|---|---|---|
| 2,680,168 | A | 6/1954 | Murphy | |
| 2,767,277 | A | 10/1956 | Wirth | |
| 4,107,492 | A | 8/1978 | Moon, Jr. et al. | |
| 4,115,878 | A | 9/1978 | Johnson et al. | |
| 4,116,577 | A | 9/1978 | Lauck | |
| 4,238,859 | A * | 12/1980 | Badon, Jr. | 4/509 |
| 4,329,120 | A | 5/1982 | Walters | |
| 4,456,432 | A | 6/1984 | Mannino | |
| 4,460,812 | A | 7/1984 | Asahi | |
| 4,505,643 | A | 3/1985 | Millis | |
| 4,602,391 | A | 7/1986 | Shepherd | |
| 4,620,835 | A | 11/1986 | Bell | |
| 4,762,969 | A | 8/1988 | Tracey | |
| 4,783,580 | A | 11/1988 | Bassin | |
| 4,867,645 | A | 9/1989 | Foster | |
| 5,120,198 | A | 6/1992 | Clark | |
| 5,167,041 | A | 12/1992 | Burkitt, III | |
| 5,190,442 | A | 3/1993 | Jorritsma | |
| 5,259,733 | A | 11/1993 | Gigliotti | |
| 5,347,664 | A | 9/1994 | Hamza | |
| 5,499,406 | A | 3/1996 | Chalberg | |
| 5,570,481 | A | 11/1996 | Mathis | |
| 6,059,536 | A | 5/2000 | Stingl | |
| 6,342,841 | B1 * | 1/2002 | Stingl | 340/626 |
| 7,440,864 | B2 * | 10/2008 | Otto | 702/119 |
| 2004/0000525 | A1 * | 1/2004 | Hornsby | 210/776 |
| 2004/0045613 | A1 * | 3/2004 | Hinojosa et al. | 137/625.47 |

* cited by examiner

*Primary Examiner* — Devon C Kramer
*Assistant Examiner* — Todd D Jacobs
(74) *Attorney, Agent, or Firm* — James Creighton Wray

(57) ABSTRACT

A pump and alarm control promotes water safety and prevents entrapment in swimming pools, spas, and water features, such as fountains and waterfalls. The pump and alarm control monitors the vacuum on the influent side of a pump for the pool, spa and/or water feature and a two speed pump for a spa and automatically detects blockages in the pool, spa and/or water feature drains. The pump and alarm control is capable of detecting entrapment and blockages in different and distinct normal pressure operating conditions. Upon detecting a blockage the pump and alarm control shuts down pump operations and activates audible and visual alarms.

20 Claims, 16 Drawing Sheets

Wiring with Non-Metallic Conduit

Wiring with Metallic Conduit

PUMP AND ALARM CONTROL

BACKGROUND OF THE INVENTION

Swimming pools and water features can be hazardous to users because of high suction in drains. Blockage of pump return lines can drop the vacuum level, causing the pump and motor to operate at high speeds which leads to their destruction. Existing patents and devices by the inventor, which are incorporated herein by reference, detect when there is a blockage in suction lines or return lines in spas and swimming pools. Different devices are required for distinct normal operating conditions which occur when the pumps are used for circulating and when the pumps are used for increased flows like those that are used in spas and various water features such as fountains and waterfalls. Needs exist for an improved pump and alarm controls that detect blockages and entrapment conditions for pools, spas, and a variety of water features under a variety of operating conditions and shuts down pump operations and sounds an alarm for safety when they occur.

SUMMARY OF THE INVENTION

A recreational water pump and alarm controller has an interrupter in a pump power circuit for interrupting the pump power circuit and stopping a pump. The controller has a contactor in an alarm control circuit for closing and powering alarms. A vacuum line is connected to a pump suction, and a vacuum sensor is connected to the vacuum line. A vacuum sensor may be mounted on the pump and a vacuum indicating line connected to the sensor and the controller for sending signals of vacuum from the pump to the controller. A vacuum level control is connected to the vacuum sensor for setting plural normal operating pump vacuum levels and plural high and low vacuum levels associated with the plural normal operating pump vacuum levels. The vacuum level controller is capable of automatically setting plural normal and high vacuum levels according to the input of plural pump and/or water operating conditions.

A vacuum switch is connected to the vacuum level control and the vacuum sensor and to the contactor and the interrupter for opening the interrupter and closing the contactor upon vacuum in the vacuum line exceeding high or low set vacuum. The apparatus also has a controller input for changing the high vacuum levels according to changed selected pump and/or water operating conditions.

In one embodiment a pump is connected to a spa and a two speed motor is connected to the pump. The pump power circuit has a remote motor speed selector for selecting between low speed operation of the motor and pump in a water circulating condition and high speed operation of the motor and pump in a water jetting condition. The controller input is changed and the vacuum level control is changed upon changing of the remote motor speed selector between low speed and high speed operations of the motor and pump.

Another embodiment provides the new controller with a swimming pool and spa combination. A pump has a motor connected to the pump power circuit. Water suction lines and return lines are connected to the pump and to the swimming pool and the spa. Valves change connections in the water suction lines and return lines for selective connection of the pump to the swimming pool and the spa for water circulation, and for isolating the pool and connecting the suction and return lines solely between the pump and the spa for jetting water in the spa. The controller vacuum levels are changed upon the changing of the valves to selectively connect the pump to the swimming pool and the spa or solely to the spa. Alternately, the invention may be configured exactly this way but with a water feature in place of or in addition to the spa.

The invention also provides a shut off and alarm controller for a swimming pool, spa and water feature such as a fountain, and a waterfall. A pump motor is connected to the pump power circuit. Suction and return lines are connected to the pump and to the swimming pool and the fountain, water feature, or waterfall. Valves in the suction and return lines change the water operating conditions and direct return from the pump to the swimming pool or to the spa or water feature such as a fountain. A connection between the valves or valve operators and the controller input changes the input to the controller when the valves are changed. The invention is configured similarly for use with a waterfall in place of the fountain.

The new flow blockage detection, shut off and alarm controller uses a pump vacuum sensor and provides pump stopping and alarm starting in different operating conditions. A first pump operating condition is input into the controller and the pump is started and operated in that condition. The pump vacuum sensor measures the first normal pump vacuum level, which is then set in the pump controller and pump vacuum sensor. Then the pump is stopped.

A second pump operating condition is then input into the controller, and the pump is started and operated in that condition. The pump vacuum sensor measures the second normal pump vacuum level, which is then set in the pump controller and pump vacuum sensor. The pump is then stopped.

A first operating condition is selected and input into the controller, and the pump is started. The pump vacuum sensor measures the operating pump vacuum level, which is then compared with the first normal pump vacuum level. If the sensed operating pump vacuum level exceeds the first normal pump vacuum level by a preset amount, the pump is stopped and the alarm is started.

The pump is stopped, a second operating condition is selected and input into the controller, and the pump is started. The pump vacuum sensor measures the operating pump vacuum level, which is then compared with the second normal pump vacuum level. If the sensed operating pump vacuum level exceeds the second normal pump vacuum level by a preset amount, the pump is stopped and the alarm is started.

In one embodiment of the method, the first operating condition is spa water circulating by low speed operation of a two speed pump, and the second operating condition is spa water jetting by high speed operation of the pump.

In another embodiment, the first operating condition is spa and pool water circulating and the second operating condition is spa jetting. To select the operating condition, valves in suction lines and return lines are redirected between the pump and the spa and the pump and the pool. The pump operating condition in the controller is then changed based upon the redirecting of the valves. When the valves are operated by remote actuators, and valve position sensors connected to the valves or actuators transmit the valve positions to the controller for setting the pump operating condition.

A new method of controlling pumps and alarms provides a pump vacuum sensor and a controller for shutting off the pump and starting an alarm. In the controller are a changeable water flow condition indicator, a pump motor supply circuit, an alarm control circuit, and a vacuum sensor. In the pump motor supply circuit is an interrupter and in the alarm control circuit is an alarm circuit completer.

A vacuum line is connected to the controller and to a suction of the pump. The vacuum line may be a fluid line or wire for conducting signals from a vacuum sensor on the pump, pump trap or on a suction pipe. The vacuum sensor measures vacuum in the vacuum line as suction of the pump. A first condition is input into the controller and the pump is operated in that condition. The vacuum sensor monitors vacuum level and first stabilized operation suction of the pump running in the first condition. First activating high and low vacuum levels are set above and below the first stabilized operation vacuum level.

The pump is then stopped, and the pump operating and the condition indicator are changed to the second operating condition. The pump is started, and the pump is operated in the second operating condition. The vacuum sensor measures vacuum level and second stabilized operation vacuum level of the pump running in the second condition. Second control activating high and low vacuum levels are set above and below the second stabilized operation vacuum level.

When the pump is run in the first condition, upon sensing vacuum level exceeding the first activating high pressure, the interrupter opens, and the alarm circuit completer closes. When the pump is then run in the second condition, upon sensing vacuum level exceeding the second, different, activating high vacuum level, the interrupter opens and the alarm circuit completer closes.

In one embodiment of the method, in the first condition the pump is connected through piping to a swimming pool and spa. In the second condition the pump is disconnected from the swimming pool and connected only to the spa. Valves are connected to the piping for circulating water in the pool and spa in the first condition, and jetting water in the spa in the second condition. The redirecting of the valves changes the condition input in the controller.

In another embodiment, the pump is connected through piping to a spa. In the first condition the pump is operated at low speed by a two speed motor for circulating water through the spa, and in the second condition the pump is operated at high speed by the two speed motor for jetting water into the spa. Changing pump speeds changes an input in the controller.

A new method of operating a recreational water system uses a water pump and motor and provides a flow blockage detection, pump shut off and alarm control in different operating conditions. A pump vacuum responsive power interrupter and alarm actuator are connected to the controller and motor for shutting off the pump and starting alarms in selected water system operations. A resettable condition input, vacuum sensor, and multiple vacuum memory are connected in the system.

A discharge side of the pump is connected to a return line. A suction side of the pump is connected to a suction line. A vacuum line is connected to the suction side of the pump and to the vacuum sensor in the safety vacuum release and alarm actuator system. A system control input is connected to the pump power interrupter and alarm actuator system and to the pump and water system controller. The condition input is placed in a first configuration. The pump and motor are operated and the vacuum sensor detects first normal operation vacuum level in a first condition. In the system memory, vacuum level first parameters are set. These parameters are not to be exceeded when operating in the first condition.

The pump is then stopped and the condition input is placed in a second configuration. The pump and motor are operated and the vacuum sensor detects second normal operation vacuum level in a second condition. In the system memory, second vacuum level parameters are set. These parameters are not to be exceeded when operating in the second condition.

The system control input is set in one condition and the pump is started. After allowing the pump to prime, when a set vacuum level parameter for that operating condition is exceeded, the pump is stopped and the alarms are actuated.

The method provides a control relay connected to the system as the system control input. The state of the control relay can be changed from the remote pump control or from valves in the water system. In one embodiment, the first operating condition uses a pump at low speed for circulating water in a spa, and the second condition uses the pump at high speed for jetting water in a spa. In another embodiment the first condition is circulating water through a pool, spa, and/or water feature. The second condition redirects the valves for returning water through the spa and/or water feature.

These and further and other objects and features of the invention are apparent in the disclosure, which includes the above and ongoing written specification, with the claims and the drawings.

DETAILED DESCRIPTION OF THE PREFERRED EMBODIMENTS

Referring to FIGS. 1-7 which show pump suction or vacuum in inches of mercury in diagrams 10, similar numbers are used for similar parts of the diagrams.

Figure 1:
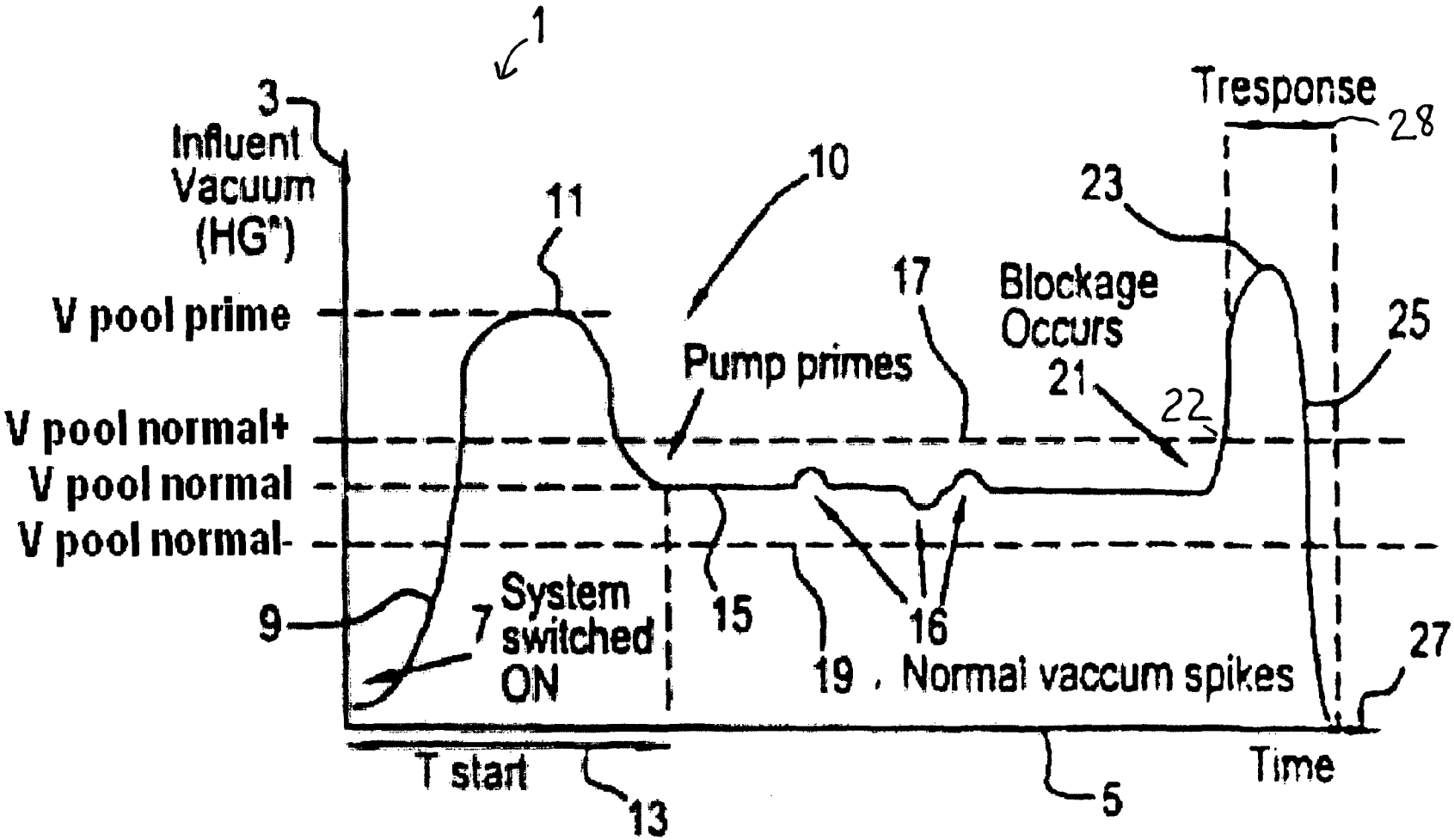
FIGS. 1-7 show pump inlet vacuum measurements in inches of Hg respectively for pool, spa, fountain, waterfall, high normal, low normal and maintenance.

FIG. 1 shows a pump vacuum-time diagram 1 when a pump is circulating water through a pool.

Figure 2:
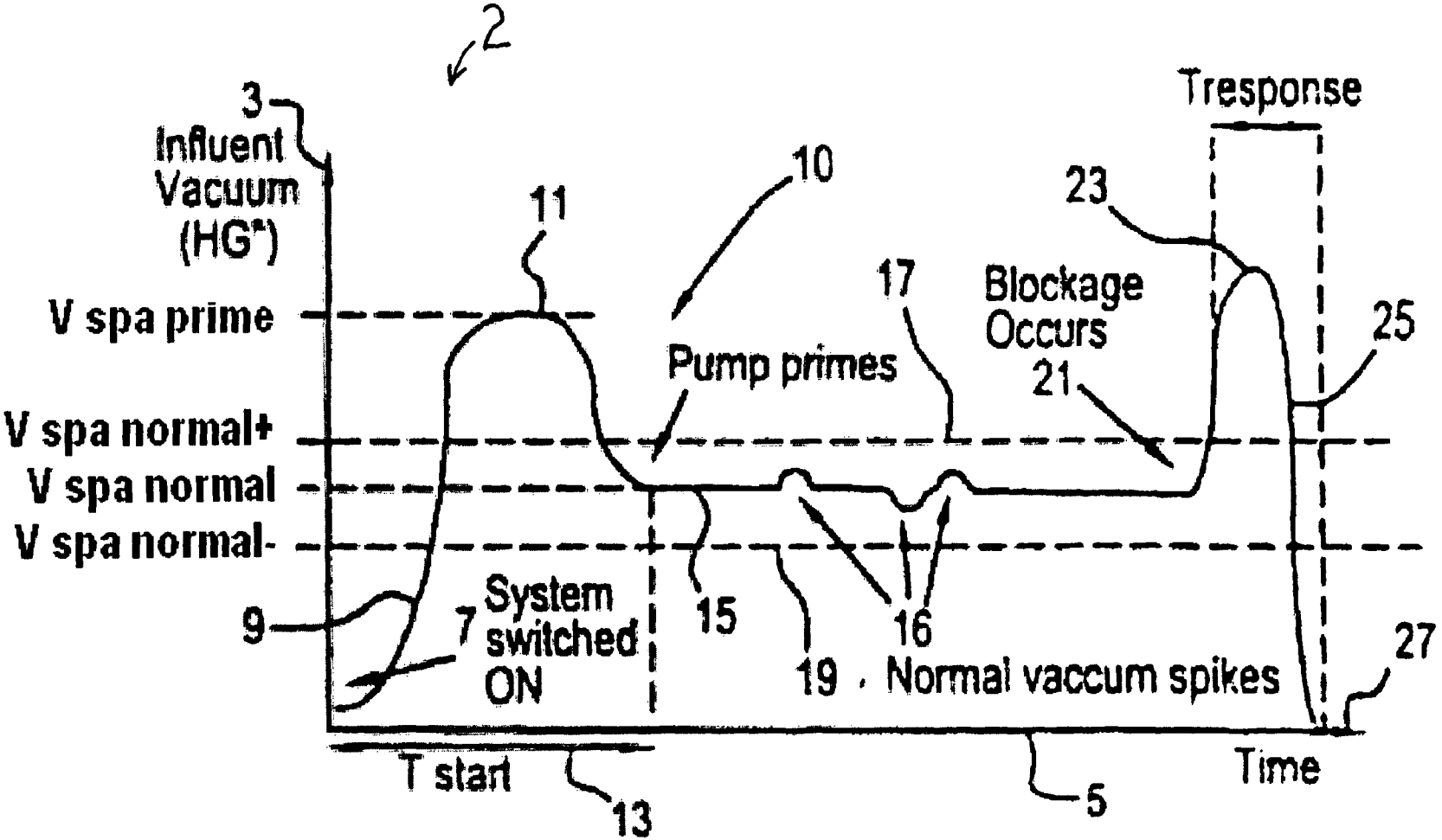

FIG. 2 shows a pump vacuum-time diagram 2 when a pump is jetting water in a spa.

Figure 3:
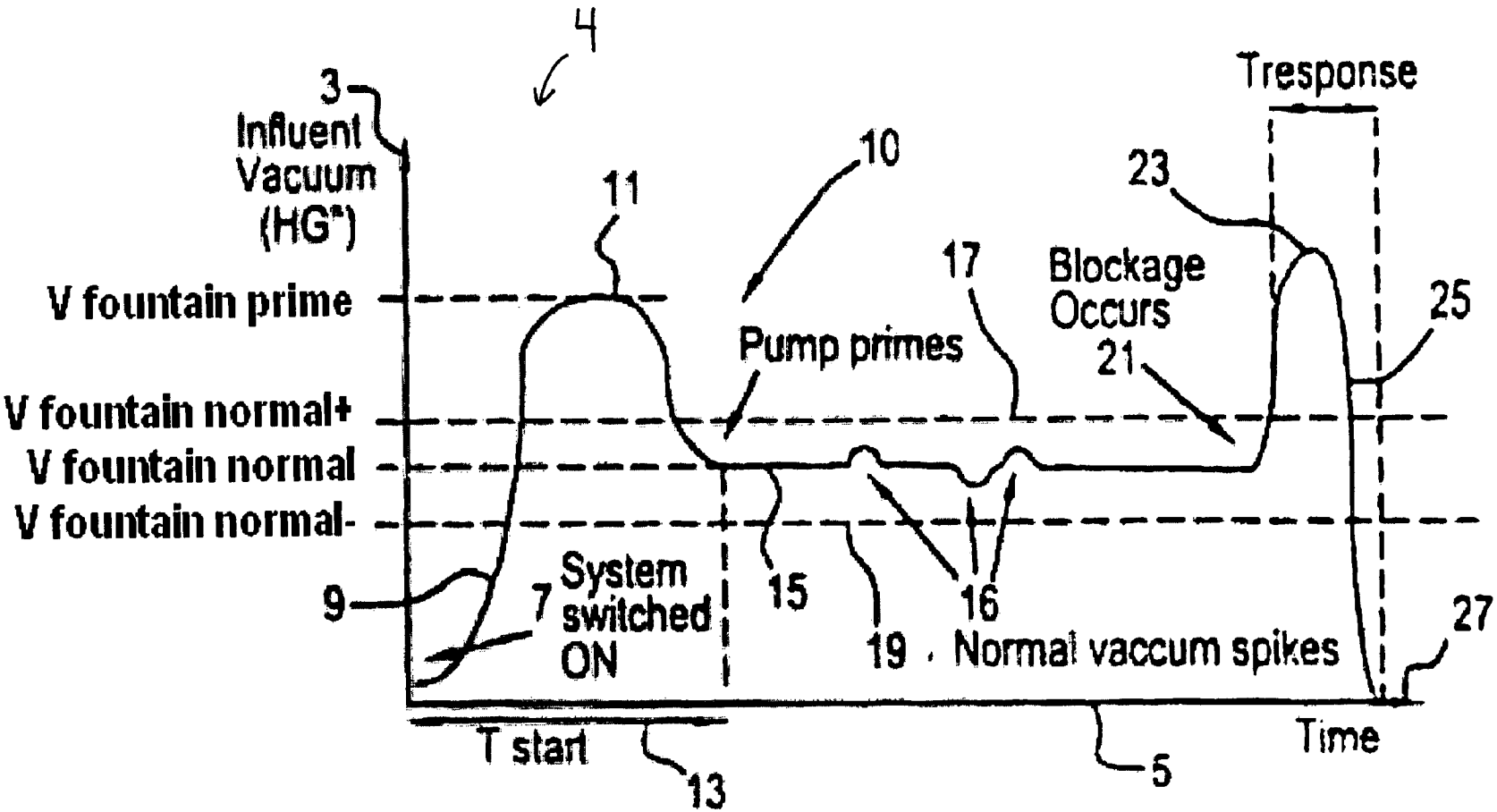

FIG. 3 shows a pump vacuum-time diagram 4 when a pump is pumping water through a fountain or similar water feature.

Figure 4:
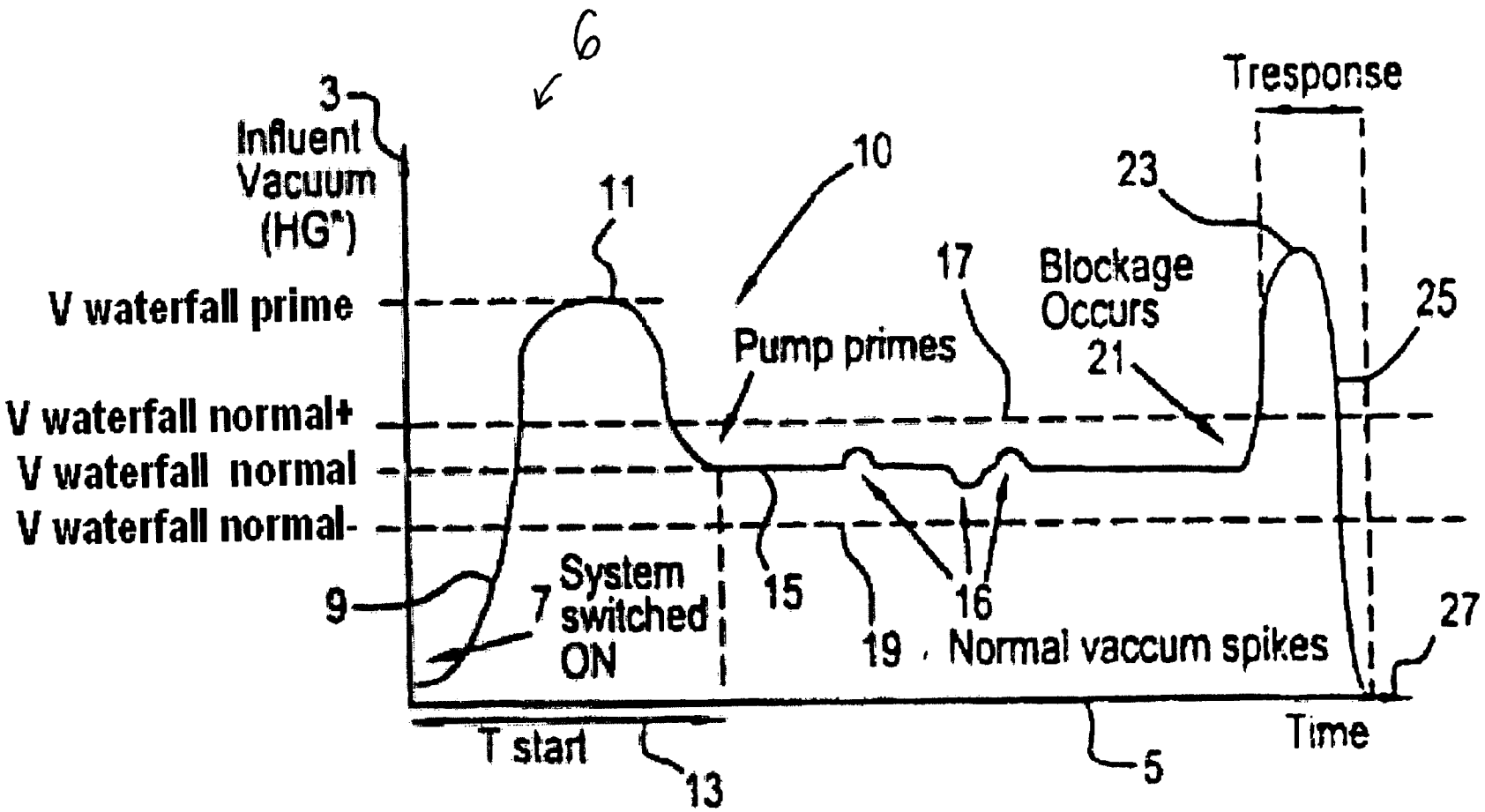

FIG. 4 shows a pump vacuum-time diagram 6 when the pump is pumping water through a waterfall.

Figure 5:
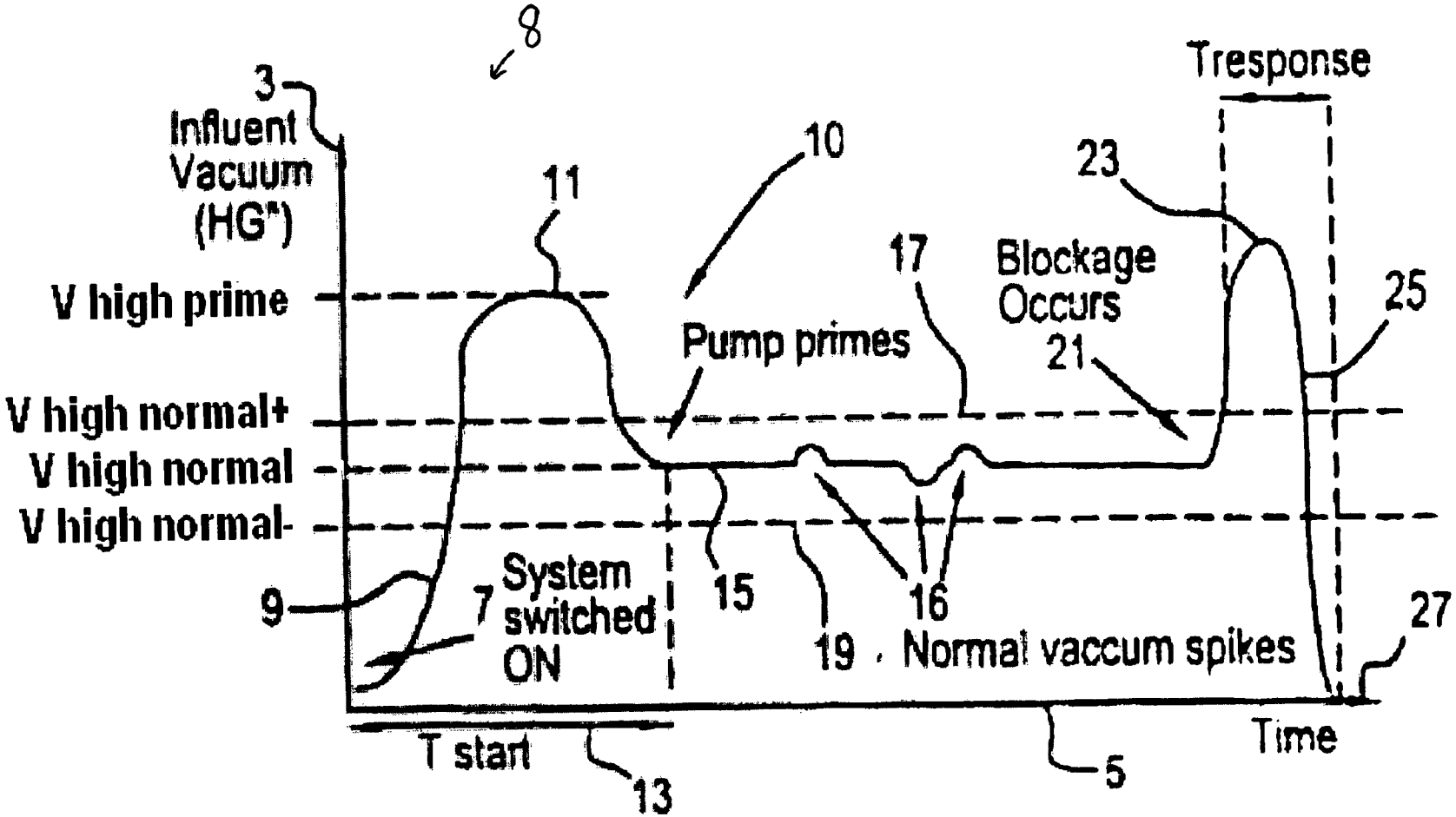

FIG. 5 shows a pump vacuum-time diagram 8 when a pump is operating at a high pressure, such as pumping water through a spa, fountain, waterfall or other water feature.

Figure 6:
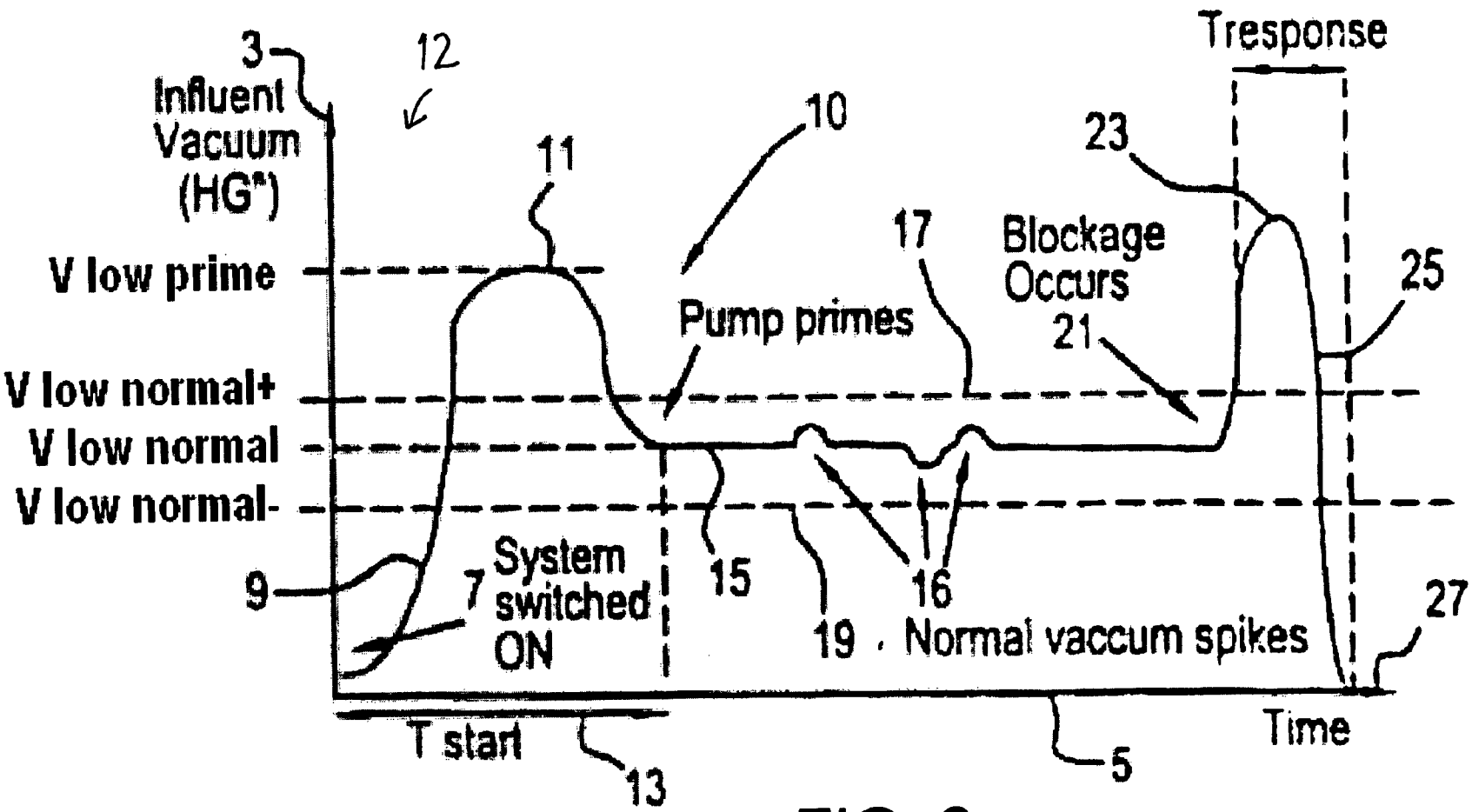

FIG. 6 shows a pump vacuum-time diagram 12 when the pump is operating at a low pressure, such as circulating water through a pool or through a pool and spa.

Figure 7:
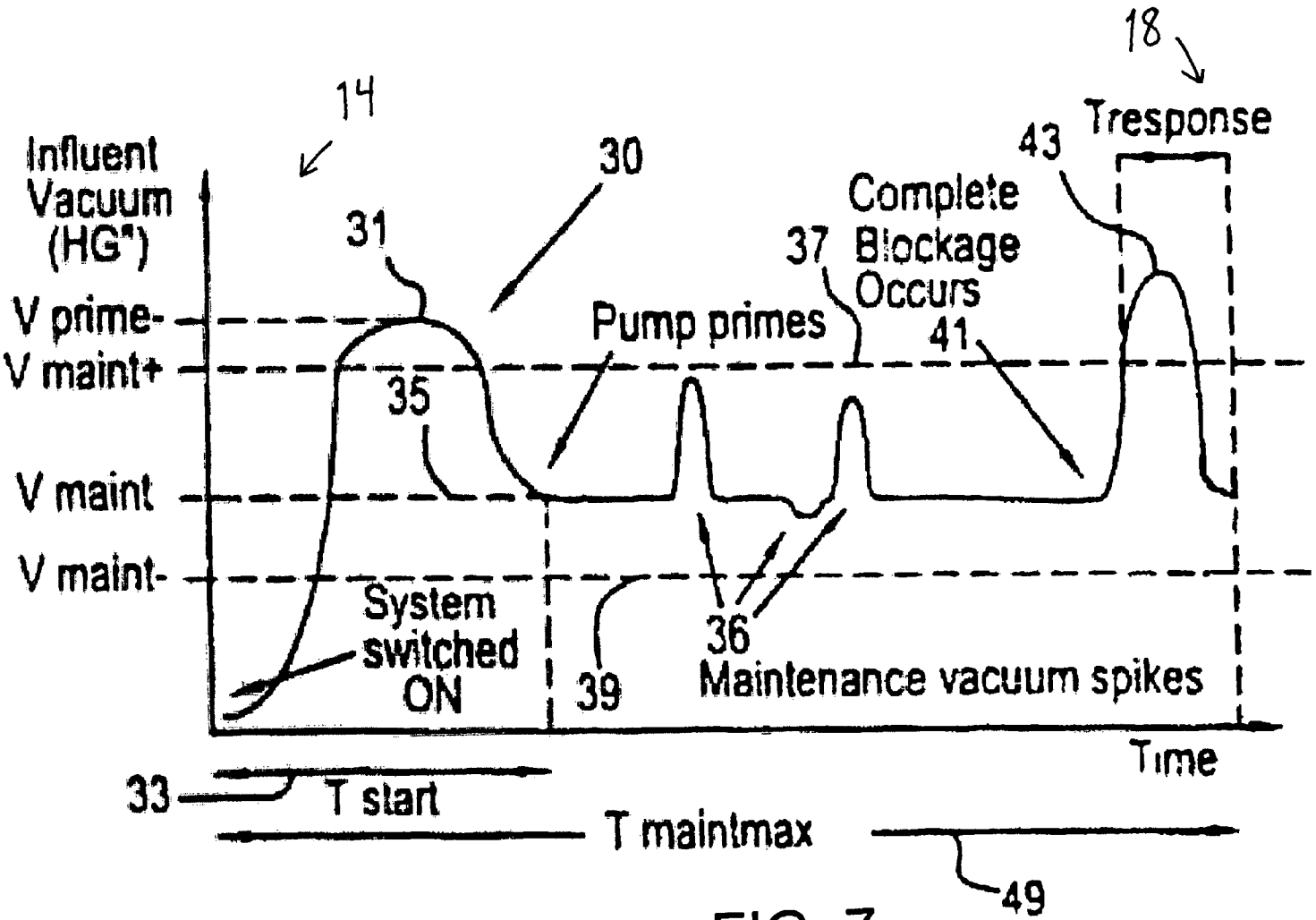

FIG. 7 shows a pump vacuum-time diagram 14 when the pump is being used for maintenance of a pool, spa or water feature.

In all of the diagrams 10, the Y direction 3 indicates the pump vacuum and the X direction 5 indicates time. When the pump is switched on 7, the pump vacuum begins to rise 9 and continues to rise to its peak 11, and after the starting time 13 when the pump is fully primed, the pump vacuum returns to normal 15. Normal positive and negative pump vacuum spikes 16 occur during normal operations of the pool pump. Preset controller activating levels of an increase in pump vacuum 17 or a decrease in pump vacuum 19 from the normal operating pump vacuum level 15 in the selected operating condition indicate the outer limits of normal vacuum levels. When a blockage occurs 21, pump vacuum spikes 23 beyond the normal preset positive increase in pump vacuum 17. At a point 22 where the pump vacuum exceeds the normal preset positive increase in pump vacuum 17, power to the pump is shut off and alarms are activated.

The pump vacuum immediately falls 25 to a zero point. The time between shutting off the pump as the pump vacuum level crosses 22 the preset normal high fluctuation 17 until the pump vacuum falls to zero is the response time 28.

For the start time 13 while the pump primes and pump prime vacuum peaks 11, the pump shutoff and alarm system are deactivated.

Reactivating the system after shutoff at point 22 requires investigating and removing the cause of shutoff and inspecting the pool.

In the spa pump vacuum-time diagram 2 shown in FIG. 2 the curves are similar, with the exception that the normal operating pressure 15 of the spa is higher than the normal operating pressure of the pool circulating pump, and the high and low ranges 17 and 19 are set at higher vacuum levels.

For the fountain pump vacuum 4 shown in FIG. 3, the curves are the same, with the exception that the pump output pressure is higher for fountain operation, and that the pump vacuum for normal fountain operation 15 is different from the normal pool circulation vacuum 15 in FIG. 1. The normal high and low vacuum limits 17 and 19 are changed accordingly. If one of the levels 17 or 19 is exceeded, as shown for example in curve 23, the pump is shut off and the alarms are started.

In a waterfall operation 6, such as shown in FIG. 4, the pump usually is operating at a higher pressure because of the necessity to lift the large volume of water to the waterfall. Because the normal pump vacuum 15 is different than in normal pool operation, the limits 17 and 19 differing from that normal vacuum are changed accordingly. The pump is shut off and the alarms are sounded when the vacuum exceeds either preset limit 17 or 19.

A pump operates in two different modes, for example circulating water in a pool and spa in one mode and stopping the circulation through the pool and jetting water in the spa in another mode.

FIG. 5 shows a high normal pump vacuum operation in which the high normal level 15 has upper and lower high normal limits 17 and 19 by which the pump turns off and the alarms activate upon exceeding the upper or lower 17, 19.

FIG. 6 shows a low normal operation 12 in which the pump operates at a low normal vacuum level 15 and the upper and lower limits 17 and 19 are set accordingly.

In all of the operations shown in FIGS. 1-6, the pump shutoff and alarm activation is deactivated during the start time 13 until the pump primes. After the start time, the systems respond to any exceeding of the upper and low limits 17 and 19 by turning off the pump and activating the alarms.

During the maintenance cycle 14, as shown in FIG. 7, the vacuum-time diagram 30 is different from the vacuum-time diagrams 10 shown in FIGS. 1-6. After the maintenance condition is selected and the pump is switched on, the pump vacuum increases until it reaches the highest vacuum 31 during the pump prime. At the end of the start time 33, the pump is primed and the pump operates at the normal pump maintenance vacuum level 35. Relatively high maintenance vacuum spikes 36 occur during maintenance vacuuming of the pool. Consequently the positive increase in pump vacuum requires a higher normal vacuum range setting 37. The low range 39 may also be set farther away from the normal maintenance operating vacuum 35.

The pump shutoff and alarm control 50 has a face plate 51 with a clear window 53, with alphanumeric display. Off/stop switch 55 immediately stops pump operation and also silences any active alarms. On/run switch button 57 toggles between timed pump run, continuous pump run and remote control modes and spa mode, as indicated in the alphanumeric display 53. Maintenance/clean push button 59 initiates the maintenance/cleaning mode of the pump and allows the pump to operate continuously for thirty minutes in the maintenance/cleaning mode. During the maintenance/cleaning mode, vacuum is not monitored, and a blockage will go undetected during the thirty minute cycle. An alarm is activated continuously while the pump is operating in maintenance mode.

The assembly of buttons 60 is used to set up modes for time, date and pump operating schedule, to set normal operating vacuum levels for different pump operating modes, and to set ranges around the operating levels which are detected during setup operations. The set button 61 selects the mode, and the +/yes button 63 and the –/no button 65 are used to answer yes or no questions and to increment or decrement the value on the display 53, for example in date and time, operating schedule and pump vacuum level and upper and lower vacuum range during selection.

The lower part of the face plate shows the appropriate locations for the vacuum sensor hose connection 67, the control wiring 68, and the power wiring 69.

Figure 11:
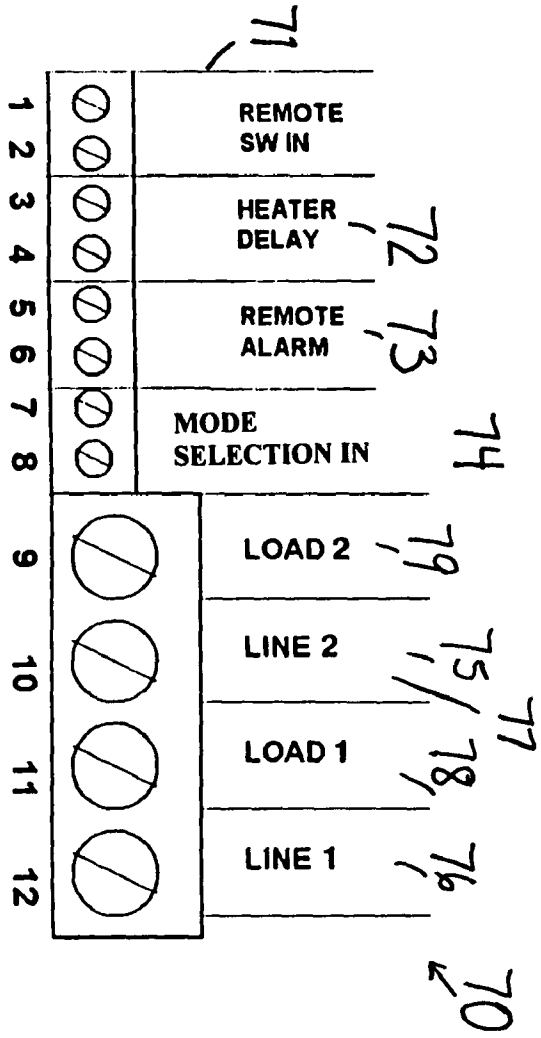
FIG. 11 is a detail of the relay connections including a connection for pump and water system condition.

The actual connectors are schematically shown 70 in FIG. 11. Two terminals are connected to the remote switch in 71 for inputting on and off signals from remote controls. The heater delay 72 provides a control signal to a heater at the pool.

Remote alarm contactors 73 provide low voltage output power to remote alarms. Mode selection in connectors 74 input the mode selected by remote control, such as by the changing of valves to direct water flow between pump and spa circulation and spa jetting, or selected pump speed for two-speed operation between spa circulating and spa jetting. Heavy duty connectors 75 connect the main power lines through heavy duty relays to connect input power lines to line 1 and line 2 connectors 76 and 77 and output power lines to the pump to load 1 connector 78 and load 2 connector 79.

Figure 9:
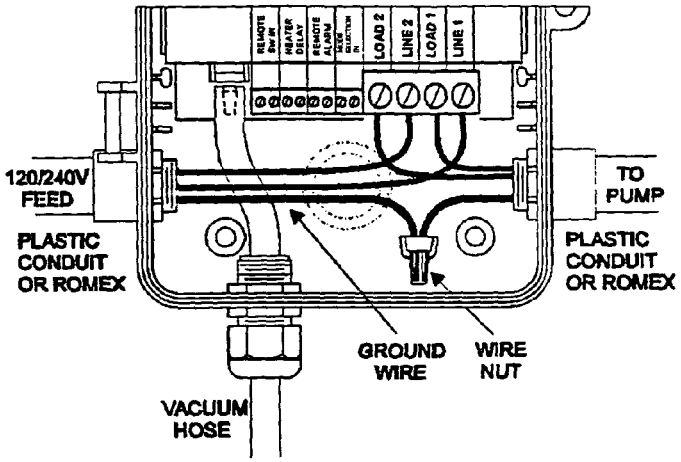
FIGS. 9 and 10 show relay wiring connections, including a position for pump and water system condition.
Figure 10:
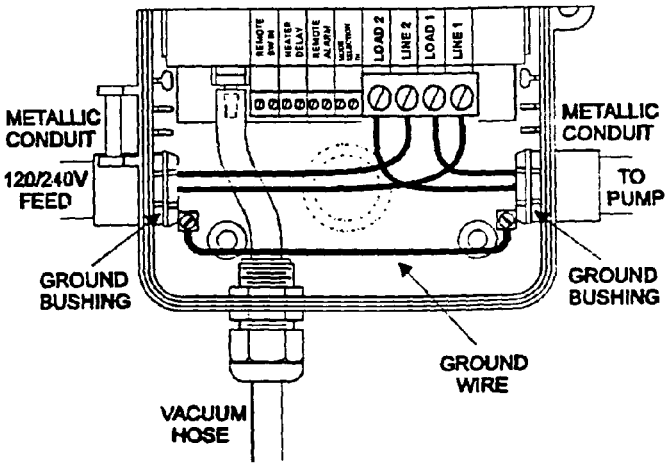

FIGS. 9 and 10 show the wiring between the pump and the feed, and the vacuum hose connection to the control.

Figure 12:
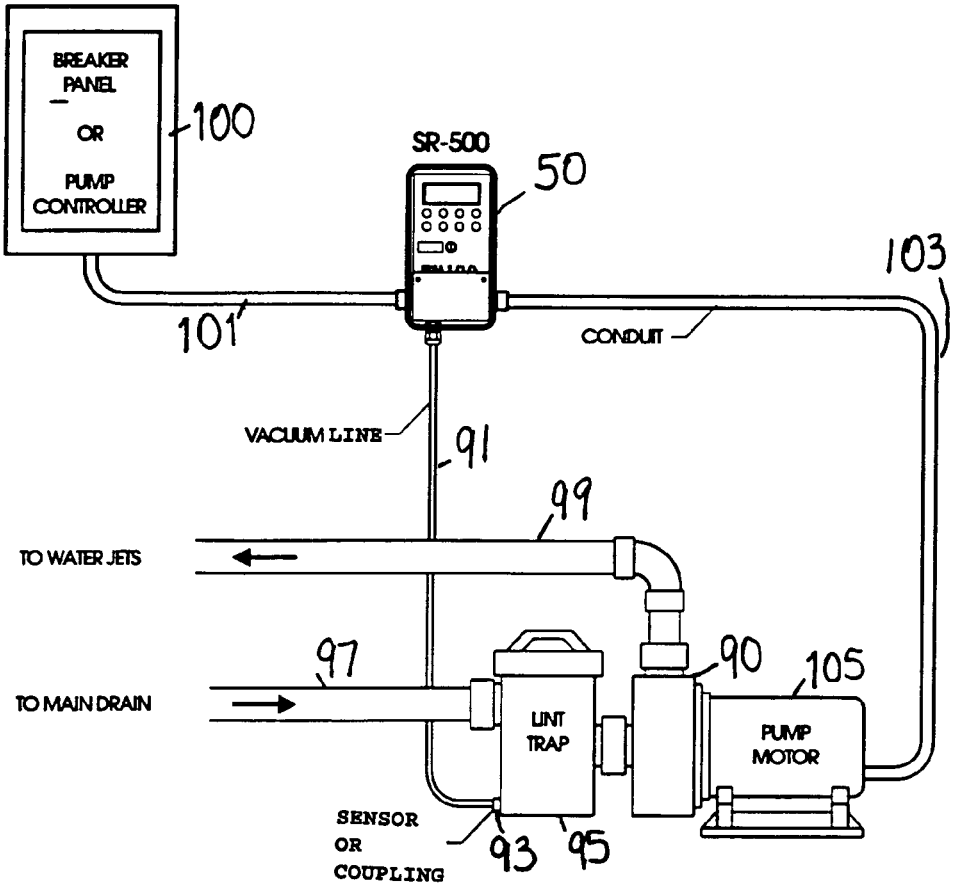
FIG. 12 shows a preferred connection of the vacuum line.

FIG. 12 shows preferred vacuum line connections between the pump 90 and the controller 50. The preferred connection of the vacuum line 91 to the pump is at the sensor or coupling 93 of the lint trap 95. Water from the main drain comes to the pump through inlet pipe 97 and exits pump 90 through return line 99 to the water jets in a circulating mode or in a water jetting mode in a spa. The vacuum line 91 may be a fluid line or wire for conducting signals from a vacuum sensor on the pump, pump trap, or on a suction pipe.

A breaker panel or pump controller 100 provides power through conduit 101 to controller 50. Relays in the controller 50 connect the power from input 101 appropriately to provide power through conduit 103 to the pump motor 105.

Figure 13:
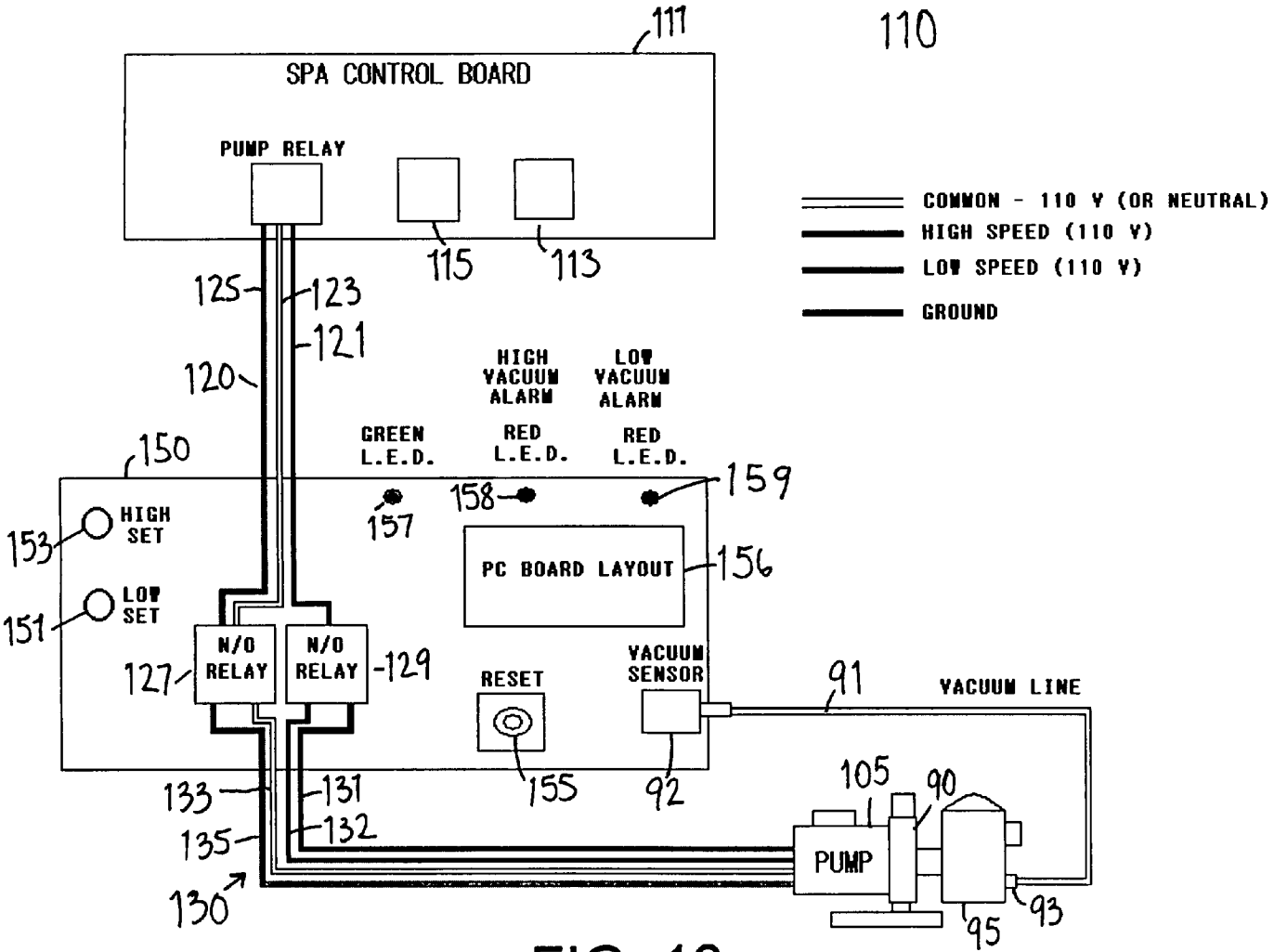
FIG. 13 schematically shows a high and low speed spa system.

In the control diagram 110 shown in FIG. 13, the spa control board 111 is a remote installation which selects by control switches or buttons 113, 115 low speed operation of a pump for circulating water in the spa, and high speed operation of pump 90 jetting water through the spa. Controller 150 has power input lines 120 from the SPA control board 111, which includes a first power line 121, a common or neutral line 123, and a ground 125. Relays 127 and 129 in the control 150 connect the input power lines 120 to output power lines 130 to the pump motor 105. The power lines between the control box 150 and the pump motor have first and second phase power lines 131 and 132 for running the pump 105 at low and high speeds and common line 133 and ground 135. The ground lines 125 and 135 are directly connected across the control box. The common line is connected via control relay 127, and the power lines 121, 131, 132 are connected by power line relay 129, depending on the pump speed selected by the spa control board 111.

Figure 8:
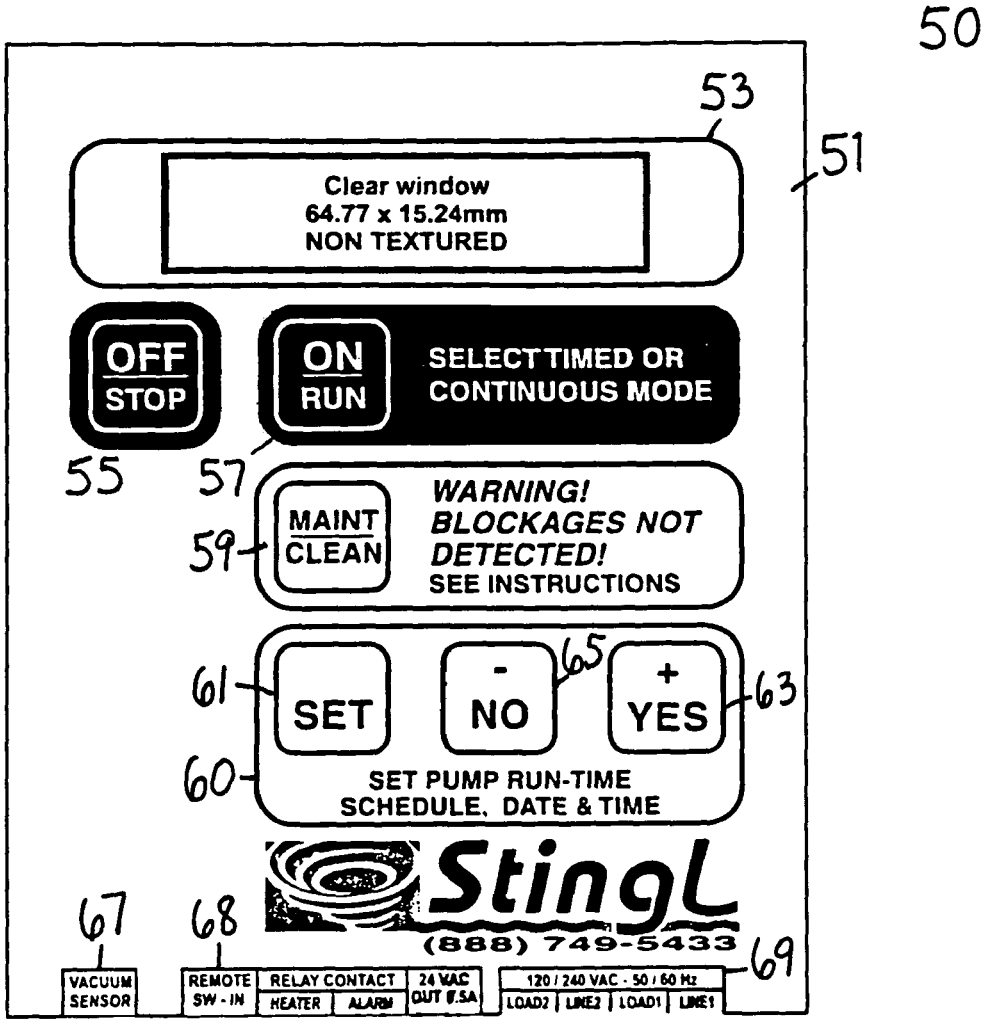
FIG. 8 shows a switch face plate with a relay position for pump and water system condition.

The controller 150 has low set and high set buttons 151 and 153. In a setup mode, the low set button 151 is pushed, and pump 90 is started with relay 129 in a low speed condition. Vacuum sensor 92 senses the vacuum on vacuum line 91 after about ten seconds for the pump priming. The sensed vacuum is input into the controller as low speed normal vacuum. Controller 150 automatically selects high and low vacuum levels 17 and 19, as shown in FIGS. 1-7. The automatically selected high and low vacuum levels for stopping the pump and actuating the alarms may be raised or lowered by selecting upper level with the set button and raising or lowered the upper level with buttons 63 or 65, as shown in FIG. 8. The same may be done for the lower level by selecting lower level with the set button and raising or lowering the lower level with buttons 63 or 65.

The differential between the normal operating vacuum experienced during setup and the upper and lower levels is controlled so that the differentials cannot be reduced beyond preset range limitations.

When the controller is fully set for the low speed operation, the pump is stopped by pushing off/stop button 55, as shown in FIG. 8.

A two speed pump controller 150 is shown in FIG. 13. The pump is started, and after about ten seconds the high speed operation vacuum on line 91 is sensed by vacuum sensor 92 in the controller 150 or vacuum sensor or coupling 93 on the pump. High set button 153 is pressed in controller 150. The vacuum level may be displayed in a window on the control panel 150. The high normal cutoff level 17 for the high vacuum normal operation may be displayed. The high cutoff level of 17 may be raised or lowered within preset constraints by pushing buttons on the controller 150. The lower cutoff and alarm level 19 for the high vacuum operation may be displayed. That lower cutoff level 19 may be raised or lowered by pressing buttons on the controller.

After blockage has been removed pressing reset/restart button 155 on controller 150 restarts the controller and the pump.

The pump is turned off, the high set button 155 is pressed and the above procedure is repeated for the high normal operation levels 15, 17 and 19, as shown in FIG. 5.

The system uses printer circuit board layout 156 with components to transform and rectify the power, control main pump power relays and to control low voltage alarm relays and heater delay relays while accepting inputs from remote pool, spa and water feature controls. A green LED 157 indicates that the system is operating. A high vacuum alarm LED 158 indicates a blockage, and a low vacuum alarm is a red LED 159 which indicates a shutoff and alarm activation from low vacuum level. In one embodiment, if both LED's 158 and 159 are illuminated, that will indicate that the pump has been shut off by a blockage and high vacuum. If only LED 159 is illuminated, that indicates that the pump has been shut off and an alarm has been activated by a low vacuum at the pump intake.

Figure 14:
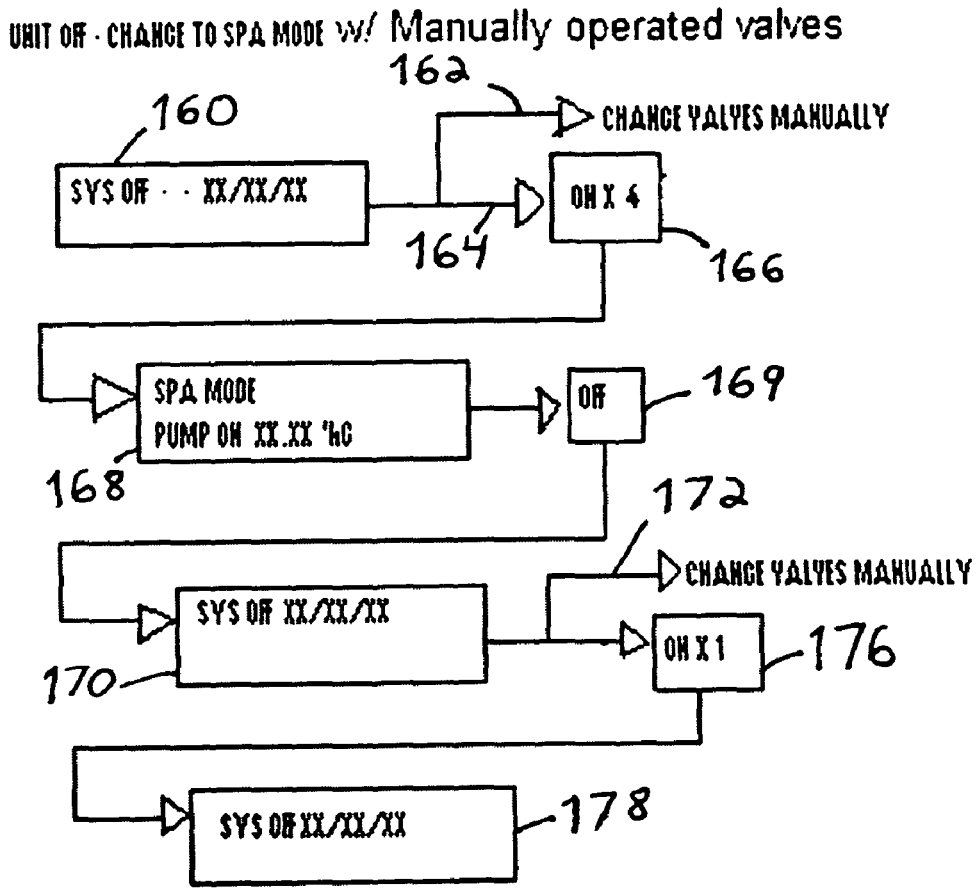
FIGS. 14 and 15 schematically show a manual pool and spa system changing.

FIG. 14 shows changing a pool and circulating mode to a spa mode with the pump shut off. The system is shut off 160, and the valves are changed manually 162. Changing the valves manually 162 may signal the remote input 74 of the selection 164 of the spa mode. Normally the valves are manually changed, and the On button 57 is pushed four times 166, toggling the display through continuous, timed, and remote modes to the spa mode, which starts the spa in the high parameter. The system runs in the spa mode until the system is turned off 169 at the remote. The control system is in the off condition 170. The valves are changed 172 to the pool and spa circulating position. Pushing the On button once 176 starts the system in continuous circulating mode. The system continues to run until the system is turned off 178 by the controller.

In changing a manually operated system, as shown in FIG. 14, the goal of the switch is to isolate the pool from the filtration system so that only the water in the spa is heated and circulated. In many cases, the user will need to switch a three-way valve on the suction side from pool to spa, and accordingly switch a return three-way from both open to spa only. Alternatively, the user will open a ball valve for the spa and shut a ball valve for the pool on the suction side, and shut a ball valve for pool return flow on the return side. Either can be accomplished in under forty-five seconds, but a timer should not be needed in a manually operated case.

Figure 15:
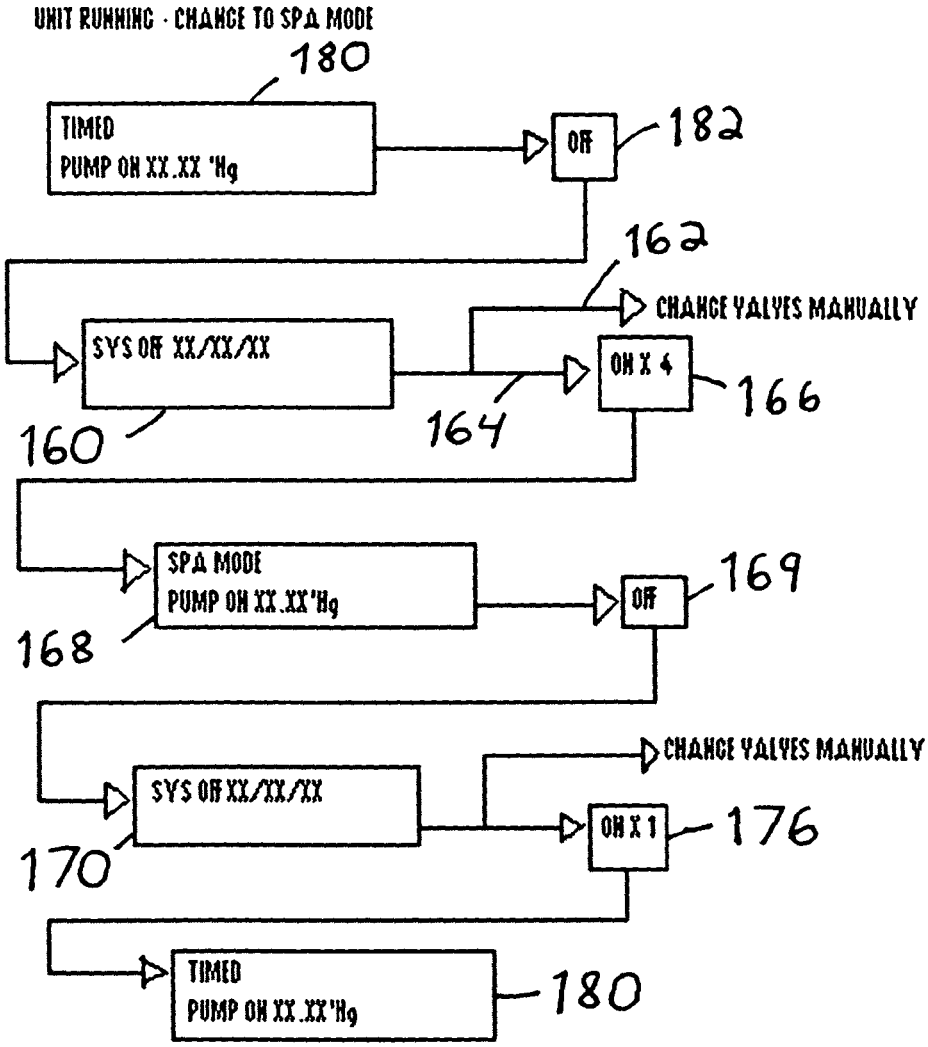

In FIG. 15, the unit is running in a timed pool and spa circulating mode 180. The remote control turns the system off 182. While the system is off 160, the valves are manually changed 162. Changing the valves manually 162 may signal the remote input 74 of the selection 164 of the spa mode. Normally the valves are manually changed, and the On button 57 is pushed four times 166, toggling the display through continuous, timed, and remote modes to the spa mode, which starts the spa in the high parameter. The system runs in the spa mode until the system is turned off 169 at the remote. The control system is in the off condition 170. The valves are changed 172 to the pool and spa circulating position. Pushing the On button once 176 starts the system in continuous circulating mode. As soon as the remote turns the system back on 176, the timed circulation 180 continues.

Figure 16:
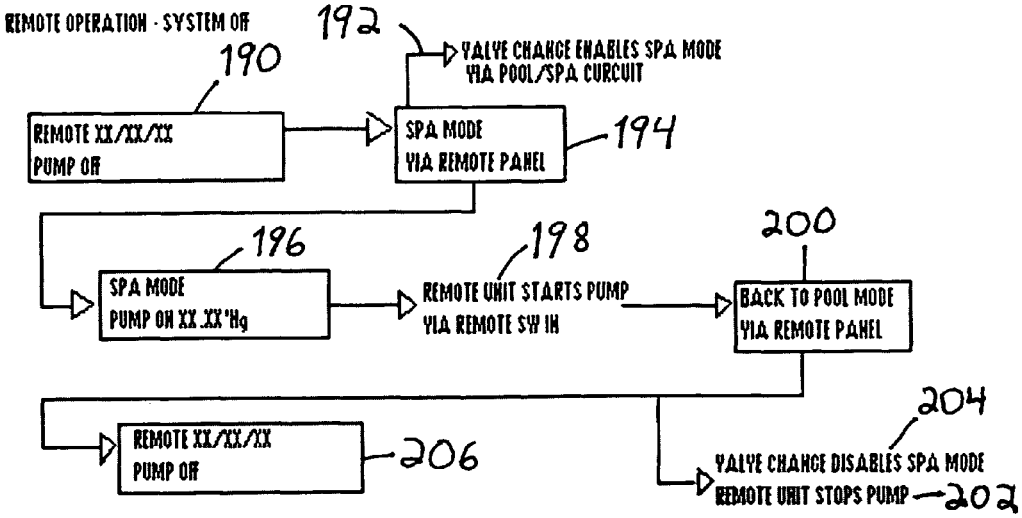
FIGS. 16 and 17 schematically show a remote operation pool and spa system changing.
Figure 17:
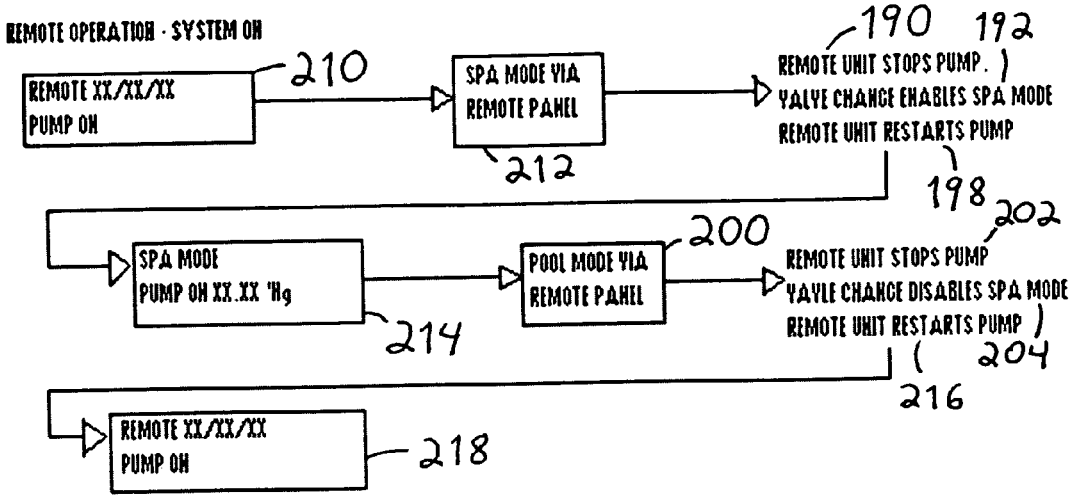

FIGS. 16 and 17 schematically show a remote operation pool and spa system changing.

As shown in FIGS. 16 and 17, valve changes on an automated system are handled by motorized actuators commanded by a remote keypad. Pump operations are already handled by the remote switch input. When the auto-system calls for the pump, it is turned on by the controller operating in remote mode. The valve change triggers the mode change in the controller in the same fashion, via a dry contact provided by an additional relay wired to the actuator relay. In an automated valve change, the only user interface is a button push on a remote keypad. That stops the pump and sends a 24 v signal to valve actuators, causing them to move to their preset positions for spa use. The actuators are preset with two stop points, and simply switch back and forth between the two points. The system then restarts the pump. In most cases the heater will be fired in a spa setting, and additional components such as air blower may be actuated. Pushing a button on the remote keypad to return to pool mode reverses the process.

As shown in FIG. 16, the remote operation of the system uses a remote control to first turn the pump off 190. The valves change to a spa mode via a pool/spa valve actuation circuit. The system changes to a spa mode 194 with the control levels in high normal condition, as shown in FIG. 5. The controller enables the pump to be started in the spa mode 196, and the remote 198 starts the pump through a signal to the controller. To return back to the pool and spa circulating mode via the remote panel 200, the remote unit stops the pump 202 and the automatic valve change 204 sends a signal to the controller to change to the circulating mode. The remote remains off 206 until it is intentionally activated.

As shown in FIG. 17 in the remote controlled operation, the system is on and the pump is on 210. The spa mode 212 is selected by the remote panel. The remote unit automatically stops the pump 190, and the valve change enables the spa mode 192 in the controller. The remote unit restarts the pump 198, and the system operates in the spa mode 214. When the pool mode is chosen by the remote panel 200, the remote unit stops the pump 202, the valve change disables the spa mode 204, and the remote unit restarts the pump 216 and the pump continues to operate 218 in the pump circulating mode.

While the invention has been described with reference to specific embodiments, modifications and variations of the invention may be constructed without departing from the scope of the invention, which is defined in the following claims.

I claim:

1. A recreational water pump and alarm controller apparatus, comprising:

a pump power circuit;

an interrupter in the pump power circuit for interrupting the pump power circuit and stopping a pump;

an alarm control circuit;

a contactor in the alarm control circuit for closing and powering alarms;

a vacuum line connected to a pump suction;

a vacuum sensor connected to the vacuum line;

a vacuum level control connected to the vacuum sensor for setting plural normal operating pump vacuum levels and high and low vacuum levels associated with the plural normal operating pump vacuum levels;

the vacuum level control being capable of setting plural high vacuum levels according to the input of plural pump and/or water operating conditions;

a vacuum switch connected to the vacuum level control and the vacuum sensor and connected to the contactor and to the interrupter for opening the interrupter and closing the contactor upon vacuum in the vacuum line exceeding high or low set vacuum;

a controller input for changing the high vacuum levels according to changed selected pump and/or water operating conditions.

2. The apparatus of claim 1, further comprising a spa, a pump connected to the spa, a two speed motor connected to the pump, connected to the pump power circuit, and connected to a remote motor speed selector for selecting between low speed operation of the motor and pump in a water circulating condition and high speed operation of the motor and pump in a water jetting condition, wherein the controller input is changed and the vacuum level control is changed upon changing of the remote motor speed selector between low speed and high speed operations of the motor and pump.

3. The apparatus of claim 1, further comprising a swimming pool and a spa, a pump and a motor connected to the pump power circuit, water suction lines and return lines connected to the swimming pool and to the spa, valves for changing water connection conditions in the water suction lines and return lines for selective connection of the pump to the swimming pool and the spa for water circulation, and for isolating the pool and connecting the suction and return lines solely between the pump and the spa for jetting water in the spa, wherein controller vacuum level parameters are changed upon the changing of the valves between the selective connection of the pump to the swimming pool and the spa or solely to the spa.

4. The apparatus of claim 1, further comprising a swimming pool and a water feature, a pump and a motor connected to the pump power circuit, water suction lines and return lines connected to the swimming pool and to the water feature, valves for changing water conditions in the water suction lines and return lines for selective connection of the pump to the swimming pool and the water feature for water circulation, and for isolating the pool and connecting the suction and return lines solely to the water feature for jetting water in the water feature, wherein controller vacuum level parameters are changed upon the changing of the valves between the selective connection of the pump to the swimming pool and the water feature or solely to the water feature.

5. The apparatus of claim 1, further comprising a swimming pool and a fountain, a pump and motor connected to the pump power circuit, a suction line connected to the swimming pool and the fountain, and return lines connected to the pump, to the fountain and to the swimming pool in the return lines for changing the water operating conditions and directing return from the pump to the swimming pool or to the fountain, and a connection between the valves or valve operators and the input for changing the input to the controller when the valves are changed.

6. The apparatus of claim 1, further comprising a swimming pool and a waterfall, a pump and motor connected to the pump power circuit, a suction line connected to the swimming pool and the waterfall, and return lines connected to the pump, to the waterfall and to the swimming pool valves in the return lines and a valve operator for changing the valves and the water operating conditions and directing return from the pump to the swimming pool or to the waterfall, and a connection between the valves or valve operators and the input for changing the input to the controller when the valves are changed.

7. A flow detection, shut off and alarm method, comprising:

providing a pump and alarm controller and pump vacuum sensor;

inputting into the controller a first pump operating condition;

starting and operating the pump in the first operating condition;

sensing a first normal pump vacuum level;

setting the first normal pump vacuum level in the pump controller and pump vacuum sensor;

stopping the pump;

inputting into the controller a second pump operating condition;

starting and operating the pump in the second operating condition;

sensing a second normal pump vacuum level;

setting the second normal pump vacuum level in the pump controller and pump vacuum sensor;

stopping the pump;

selecting a first operating condition;

inputting the first operating condition in the controller;

starting the pump;

sensing the operating pump vacuum level;

comparing the sensed operating pump vacuum level with the first normal pump vacuum level;

stopping the pump and starting an alarm if the sensed operating pump vacuum level exceeds the first normal pump vacuum level by a preset amount;

stopping the pump;

selecting a second operating condition;

inputting the second operating condition in the controller;
starting the pump;
sensing the operating pump vacuum level;
comparing the sensed operating pump vacuum level with the second normal pump vacuum level;
stopping the pump and starting the alarm if the sensed operating pump vacuum level exceeds the second normal pump vacuum level by a preset amount.

8. The method of claim 7, wherein the first operating condition is spa water circulating by low speed operation of the pump, the second operating condition is spa water jetting by high speed operation of the pump, the selecting comprises selecting between the low speed and high speed operations, and the inputting comprises inputting the selected first or second condition in the controller in response to the selecting.

9. The method of claim 7, wherein the first operating condition is spa and pool water circulating, the second operating condition is spa jetting, the selecting comprises redirecting valves in suction lines and return lines between the pump and the spa and the pump and the pool, and the inputting comprises changing the pump operating condition in the controller upon the redirecting of the valves.

10. The method of claim 9, wherein the valves are operated by remote actuators, and wherein valve position sensors connected to the valves or actuators transmit the valve positions to the controller for inputting the valve position as the pump operating condition.

11. A method of controlling pumps and alarms, comprising:
providing a controller;
providing a changeable condition indicator in the controller;
providing a pump motor supply circuit in the controller;
providing an interrupter in the pump motor supply circuit;
providing an alarm control circuit in the controller;
providing an alarm circuit completer in the alarm control circuit;
providing a vacuum sensor;
providing a pump;
connecting a vacuum line to the vacuum sensor;
sensing vacuum in the vacuum line as vacuum level of the pump;
inputting a first condition in the controller;
operating the pump in the first condition;
sensing vacuum level of the pump operating in the first condition;
sensing first stabilized operation vacuum level of the pump running in the first condition;
setting first activating high and low vacuum levels above and below the first stabilized operation vacuum level;
stopping the pump;
changing pump operating condition to a second operating condition;
changing the condition indicator to the second operating condition;
starting the pump;
operating the pump in the second operating condition;
sensing vacuum level of the pump in the second operating condition;
sensing second stabilized operation vacuum level of the pump running in the second condition;
setting second activating high and low vacuum level above and below the second stabilized operation vacuum level;
running the pump in the first condition;
opening the interrupter and closing the alarm circuit completer upon sensing the vacuum level exceeding the first activating high pressure;
running the pump in the second condition, opening the interrupter and closing the alarm circuit completer upon sensing the vacuum level exceeding the second activating high vacuum level.

12. The method of claim 11, wherein in the first condition the pump is connected through piping to a swimming pool and spa, and in the second condition the pump is disconnected from the swimming pool and connected only to the spa.

13. The method of claim 11, wherein the pump is connected through piping to a spa, wherein in the first condition the pump is operated at low speed by a two speed motor for circulating water through the spa, and wherein in the second condition the pump is operated at high speed by the two speed motor for jetting water into the spa.

14. The method of claim 11, wherein in the first condition the pump is connected through piping to a swimming pool and spa, and in the second condition the pump is disconnected from the swimming pool and connected only to the spa, and further comprising redirecting valves connected to the piping for circulating water in the pool and spa in the first condition, and jetting water in the spa in the second condition, and wherein the redirecting of the valves changes the changeable indicator in the controller.

15. A method of operating a recreational water system, comprising:
providing a water pump and motor;
providing a pump and water system controller;
connecting a pump vacuum responsive power interrupter and alarm actuator system to the pump and water system controller and the motor for stopping the pump and actuating alarms connected to the alarm actuator;
connecting a resettable condition input in the system;
connecting a vacuum sensor in the system;
connecting a vacuum memory in the system;
connecting a discharge side of the pump to a return line;
connecting a suction side of the pump to a main suction line;
connecting a vacuum line in the system to the vacuum sensor;
connecting a system control input to the pump power interrupter and alarm actuator system and to the pump and water system controller;
placing the condition input in a first configuration;
operating the pump and motor in a first condition;
sensing first normal operation vacuum level in the first condition;
setting in the system memory vacuum level first parameters not to be exceeded according to the first normal operating vacuum level when operating in the first condition;
stopping the pump;
placing the condition input in a second configuration;
operating the pump and motor in a second condition;
sensing second normal operation vacuum level in the second condition;
setting in the system memory vacuum level second parameters not to be exceeded according to the second normal operating vacuum level when operating in the second condition;
setting the system control input in one condition;
starting the pump, allowing the pump to prime; and
stopping the pump and actuating the alarms when a set vacuum level parameter for that operating condition is exceeded.

16. The method of claim 15, wherein the connecting of the system control input comprises connecting a control relay to the system.

17. The method of claim 16, further comprising changing the state of the control relay from the pump controller.

18. The method of claim 17, wherein the operating the pump in a first condition comprises operating the pump motor at a first, low speed for circulating water in a spa, and wherein the operating the pump in a second condition comprises operating the pump and motor at a second high speed for jetting water in a spa.

19. The method of claim 16, further comprising changing the state of the control relay from valves in the water system.

20. The method of claim 19, wherein the operating the pump and water system in a first condition comprises operating the pump and circulating water through pipes with valves through a pool and water feature, including a spa, fountain or waterfall, and wherein operating the pump motor at a second condition comprises redirecting the valves for returning water through the water feature.

* * * * *